US010424275B2

(12) United States Patent
Fukatsu et al.

(10) Patent No.: US 10,424,275 B2
(45) Date of Patent: Sep. 24, 2019

(54) UPRIGHT PIANO

(71) Applicant: YAMAHA CORPORATION, Hamamatsu-shi (JP)

(72) Inventors: Keiichi Fukatsu, Hamamatsu (JP); Azumi Yoshida, Hamamatsu (JP); Hiroshi Komada, Nagoya (JP); Hitoshi Izutani, Zhejiang (CN); Taishi Shinohara, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/185,550

(22) Filed: Nov. 9, 2018

(65) Prior Publication Data

US 2019/0147835 A1 May 16, 2019

(30) Foreign Application Priority Data

Nov. 16, 2017 (JP) ..... 2017-221322

(51) Int. Cl.

| | |
|---|---|
| ***G10C 3/06*** | (2006.01) |
| ***G10C 3/12*** | (2006.01) |
| ***G10C 3/02*** | (2006.01) |
| ***G10C 1/02*** | (2006.01) |

(52) U.S. Cl.

CPC ..... *G10C 3/06* (2013.01); *G10C 1/02* (2013.01); *G10C 3/02* (2013.01); *G10C 3/12* (2013.01)

(58) Field of Classification Search

CPC ..... G10C 3/06; G10C 1/02; G10C 3/02
See application file for complete search history.

(56) References Cited

U.S. PATENT DOCUMENTS

| | | | | | |
|---|---|---|---|---|---|
| 163,745 | A * | 5/1875 | Colley | G10C 3/06 | 84/189 |
| 186,397 | A * | 1/1877 | Zachariae | G10C 3/06 | 84/189 |
| 758,694 | A * | 5/1904 | Riggins | G10C 3/06 | 84/189 |
| 807,714 | A * | 12/1905 | Beum | G10C 3/06 | 84/189 |
| 831,852 | A * | 9/1906 | Freeborne | G10C 3/06 | 84/189 |
| 877,839 | A * | 1/1908 | Field | G10C 3/02 | 84/181 |
| 948,391 | A * | 2/1910 | Danquard et al. | G10C 3/06 | 84/189 |
| 1,121,166 | A * | 12/1914 | Clark | G10C 3/06 | 84/189 |

(Continued)

FOREIGN PATENT DOCUMENTS

JP 2012185330 A 9/2012

*Primary Examiner* — Robert W Horn
(74) *Attorney, Agent, or Firm* — Rossi, Kimms & McDowell LLP

(57) ABSTRACT

An upright piano includes an internal space enclosed by a case including an upper front board disposed above a key bed and a lower front board disposed below the key bed, and a resonance tube in which a hollow region having an opening is formed and that is disposed in the internal space, in which the opening is disposed at the left end of the lower end of the upper front board or the upper end of the lower front board, or at the right end of the lower end of the upper front board or the upper end of the lower front board.

9 Claims, 9 Drawing Sheets

(56) References Cited

U.S. PATENT DOCUMENTS

| | | | | | |
|---|---|---|---|---|---|
| 1,129,443 | A * | 2/1915 | Billings | G10C 3/02 | 84/181 |
| 1,530,984 | A * | 3/1925 | Crippen | G10C 3/06 | 84/189 |
| 1,664,191 | A * | 3/1928 | Collen | G10C 3/02 | 84/180 |
| 2,081,704 | A * | 5/1937 | Heller | G10C 1/00 | 84/174 |
| 2,087,033 | A * | 7/1937 | Huseby | G10C 1/00 | 84/170 |
| 2,255,865 | A * | 9/1941 | Watts | G10C 3/06 | 84/194 |
| 2,412,212 | A * | 12/1946 | Gerlat | G10B 3/16 | 84/189 |
| 2,948,179 | A * | 8/1960 | Itoikawa | G10C 3/06 | 84/189 |
| 3,669,214 | A * | 6/1972 | Matsuura | G10C 3/06 | 181/164 |
| 4,377,102 | A * | 3/1983 | Mayerjak | G10C 3/04 | 84/184 |
| 7,301,084 | B2 * | 11/2007 | Okada | G10C 3/02 | 84/172 |
| 9,779,711 | B2 * | 10/2017 | Ohnishi | G10D 3/02 | |
| 2012/0222541 | A1 | 9/2012 | Ishimura et al. | | |

* cited by examiner

UPRIGHT PIANO

CROSS-REFERENCE TO RELATED APPLICATIONS

Priority is claimed on Japanese Patent Application No. 2017-221322, filed Nov. 16, 2017, the content of which is incorporated herein by reference.

BACKGROUND OF THE INVENTION

Field of the Invention

The present invention relates to an upright piano provided with an acoustic resonator.

Description of Related Art

Standing waves generated in the cabinet of an upright piano influence the frequency characteristic of the acoustic space. For example, a phenomenon occurs in which the sounds of frequencies corresponding to specific keys are heard intensified or attenuated. Conventionally, as a technique for suppressing standing waves generated in the acoustic space, resonator sound absorption using a resonance tube is known.

Japanese Unexamined Patent Application Publication No. 2012-185330 describes an electronic musical instrument that adjusts the frequency characteristic by controlling the fixed vibration mode of a specific resonance frequency generated in the housing during sound emission. It is possible to reduce the sound pressure of a specific frequency in the housing by arranging the opening of the acoustic resonator in at least one of the antinodes of sound pressure in the fixed vibration mode of a specific frequency.

However, in the electronic musical instrument described in Japanese Unexamined Patent Application Publication No. 2012-185330, the frequency characteristic in the housing sometimes changes by arranging an acoustic resonator in the housing. An upright piano has a wider dynamic range than an electronic musical instrument and also has a complicated frequency characteristic. As a result, arranging an acoustic resonator in the case of an upright piano can lead to unintended effects on the frequency characteristic, such as for example disturbance of the sound field inside the case in the high-frequency band.

In addition, when the opening of the acoustic resonator is positioned at the antinode of sound pressure in a fixed vibration mode at a plurality of frequencies, the acoustic resonator reduces the sound pressure of unintended frequencies, and in some cases, leads to the occurrence of unintended effects on the frequency characteristic.

Also, when arranging the acoustic resonator in the case of an upright piano, it is necessary to avoid impairing the external appearance as much as possible.

The present invention was achieved in view of the above circumstances. The object of the present invention is to provide an upright piano that, by having an acoustic resonator disposed in a case thereof, is capable of suppressing standing waves of a specific resonance frequency generated in the case, with unintended effects on the frequency characteristic being minimal and the external appearance not being impaired.

SUMMARY OF THE INVENTION

In order to solve the above-mentioned problem, an upright piano according to the present invention includes a case including an upper front board, a key bed disposed below the upper front board, and a lower front board disposed below the key bed, defining an internal space; and a resonance tube, provided with a hollow region and an opening, disposed in the internal space, in which the opening is disposed at a left or right end side of either a lower end side of the upper front board or an upper end side of the lower front board.

DETAILED DESCRIPTION OF THE INVENTION

First Embodiment

Hereinafter, an upright piano 100 according to a first embodiment of the present invention will be described with reference to FIGS. 1 to 5. In order to make the drawings easier to comprehend, the thickness and dimension ratio of each constitutional element have been suitably adjusted.

Figure 1:
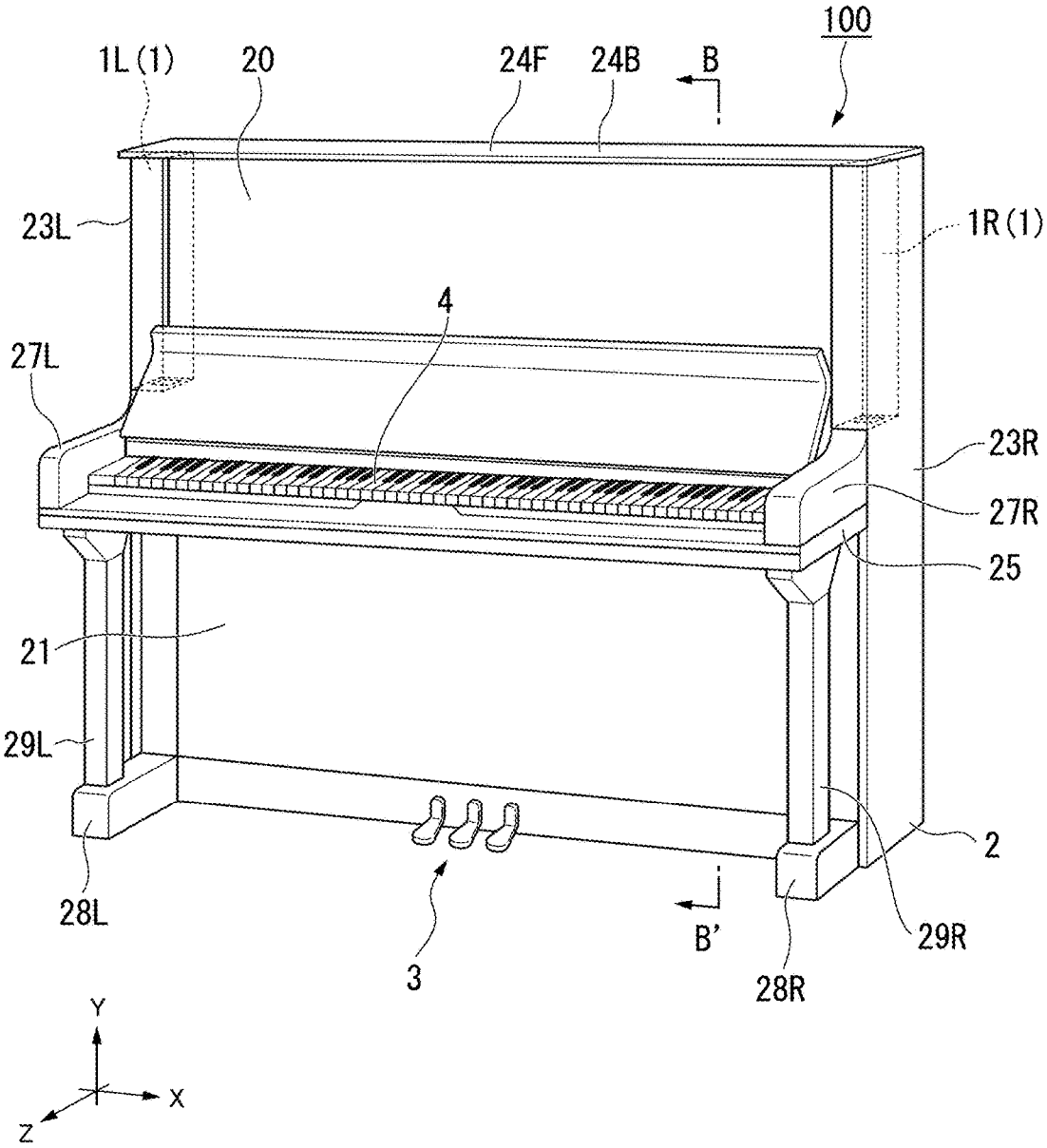
FIG. 1 is a perspective view showing an upright piano according to a first embodiment of the present invention.
Figure 2:
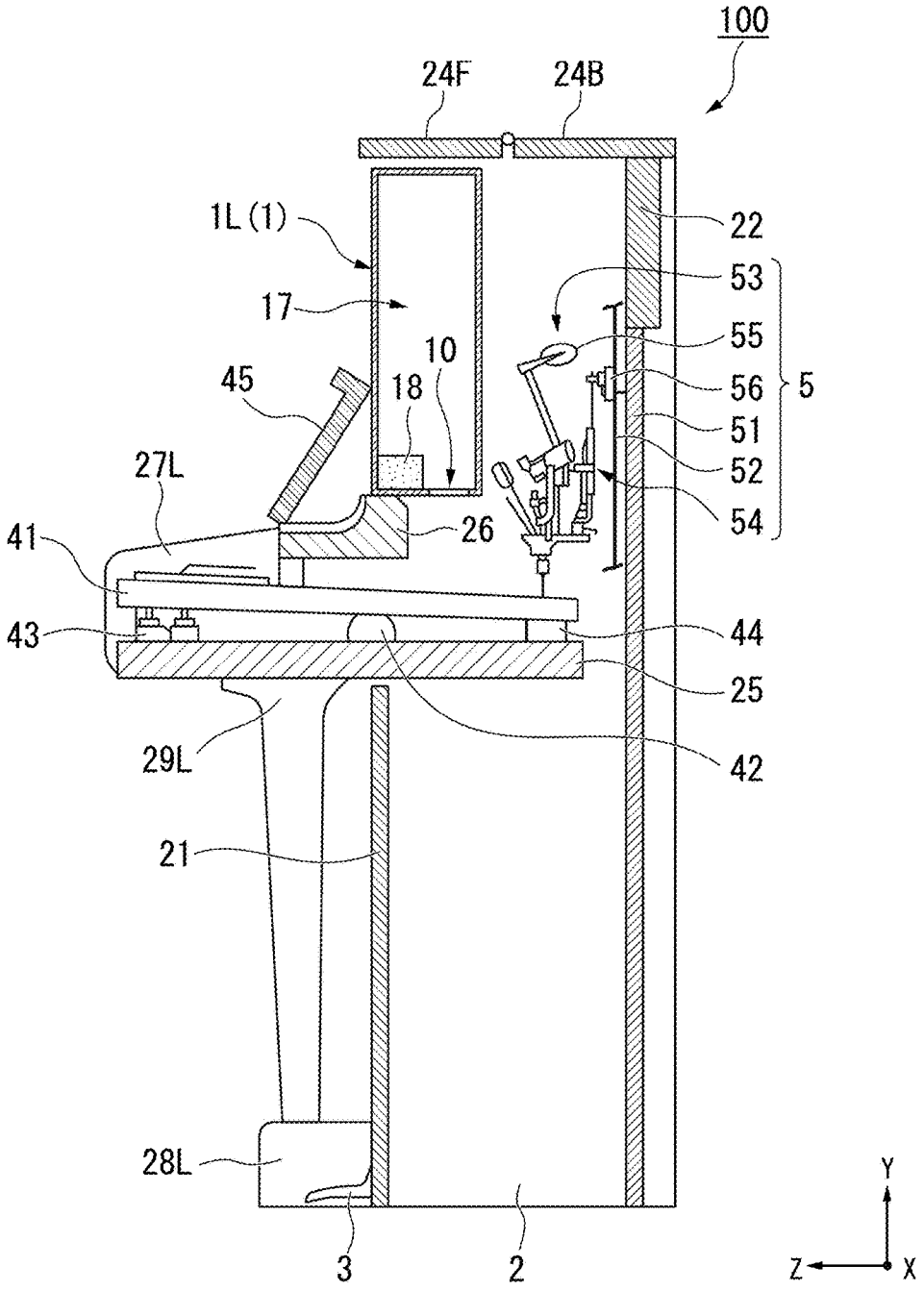
FIG. 2 is a cross-sectional view taken along line B-B' of the upright piano shown in FIG. 1.

FIG. 1 is a perspective view showing the entire constitution of the upright piano 100. FIG. 2 is a cross-sectional view taken along line B-B' of the upright piano 100 shown in FIG. 1.

As shown in FIGS. 1 and 2, the upright piano 100 is provided with a case 2 including an acoustic resonator (resonance tube) 1, a pedal unit 3, a keyboard 4, and a sound generating unit 5. In the present embodiment, the acoustic resonator 1 is a left and right pair of pilaster-shaped acoustic resonators (resonance tubes) 1L and 1R, and is a member substituted for the pilasters of an upright piano.

As shown in FIGS. 1 and 2, the case 2 includes the left and right pair of pilaster-shaped acoustic resonators 1L and 1R, an upper front board 20, a lower front board 21, a pin board 22, a left and right pair of side boards 23L and 23R, a rear top board 24B, a front top board 24F, a key bed 25, and a front rail 26. The case 2 further includes a left and right pair of side arms 27L and 27R, a left and right pair of toe blocks 28L and 28R, and a left and right pair of legs 29L and 29R. In the following description, the left-right direction is referred to as the X axis.

As shown in FIGS. 1 and 2, the upper front board 20 and the lower front board 21 are spaced apart from each other in the vertical direction (hereinafter referred to as the Y-axis direction). The upper front board 20 is disposed above the key bed 25, and the lower front board 21 is disposed below the key bed 25. A soundboard 51 is disposed opposing the upper front board 20 and the lower front board 21 in the front-rear direction (Z-axis direction) perpendicular to the X axis and the Y axis.

As shown in FIGS. 1 and 2, the upper front board 20 is integrally constituted with the left and right pair of pilaster-shaped acoustic resonators 1L and 1R that are attached to both sides of the upper front board 20. The upper front board 20 is sandwiched from the left and right by the pair of side boards 23L and 23R. The lower front board 21, the soundboard 51 and the pin board 22 are also sandwiched from the left and right directions by the pair of side boards 23L and 23R.

As shown in FIGS. 1 and 2, the rear top board 24B and the front top board 24F cover upper ends of the upper front board 20, the lower front board 21, the pin board 22, and the side boards 23L and 23R. The key bed 25, the front rail 26 and the pair of side arms 27L and 27R project frontward from an opening enclosed by a lower end of the upper front board 20, an upper end of the lower front board 21, and inner wall surfaces of the pair of side boards 23L and 23R.

As shown in FIGS. 1 and 2, the pair of toe blocks 28L and 28R project frontward from left and right ends, respectively, of a lower portion of the lower front board 21. The pair of legs 29L and 29R are installed between the back surface of the key bed 25 and each of the toe blocks 28L and 28R.

As shown in FIG. 1, the pedal unit 3 is an operating member that is operated by the performer's foot. The pedal unit 3 is exposed from the lower center of the lower front board 21 of the case 2.

As shown in FIGS. 1 and 2, the keyboard 4 is provided on the key bed 25. The keyboard 4 has keys 41, a balance rail 42, a front rail 43, a back rail 44, and a fall board 45. The keys 41 are arranged between the side arm 27L and the side arm 27R on the key bed 25 of the case 2. The keys 41 are supported by the balance rail 42 on the key bed 25. The front rail 43 and the back rail 44 are respectively arranged in front and behind the balance rail 42 on the key bed 25. The fall board 45 is provided at the distal end of the front rail 26.

As shown in FIG. 2, the sound generating unit 5 is provided in an internal space (acoustic space) which is surrounded by the upper front board 20, the lower front board 21, the pin board 22, the soundboard 51, the rear top board 24B, and the front top board 24F of the case 2. The sound generating unit 5 has the soundboard 51, strings 52, an action mechanism 53, and a damper mechanism 54.

The soundboard 51 is disposed below the pin board 22. The strings 52, as sounding bodies, are stretched over the surface of the soundboard 51 facing the keys 41. The action mechanism 53 and the damper mechanism 54 are provided above the rear end portion of the keys 41. The action mechanism 53 is a mechanism for converting a key depression force with which the player's finger depresses the key 41 into a string-striking force with which a hammer 55 strikes the string 52. The damper mechanism 54 converts the key depression force that depresses the key 41 and a stepping force of the player stepping on a damper pedal 33 into a string separation force that causes the damper 56 to separate from the strings 52.

Figure 3:
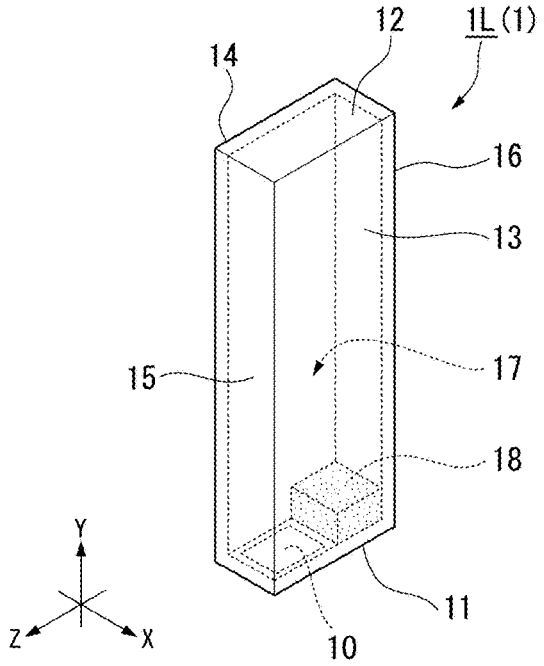
FIG. 3 is a perspective view showing an acoustic resonator used in the upright piano according to the embodiment of the present invention.

FIG. 3 is a perspective view showing the entire configuration of the pilaster-shaped acoustic resonator 1L, which is one of the pair of pilaster-shaped acoustic resonators 1L and 1R. Since the pair of pilaster-shaped acoustic resonators 1L and 1R are symmetrically constituted in the left-right direction, explanation of the pair of pilaster-shaped acoustic resonators 1L and 1R will be made with respect to only the pilaster-shaped acoustic resonator 1L.

As shown in FIG. 3, the pilaster-shaped acoustic resonator 1L is a resonance tube having one open end. That is, the acoustic resonator 1L has a first end 11 having an opening 10 at its one end and a second end 12 at its opposite end. The pilaster-shaped acoustic resonator 1L is formed in a square pillar shape constituting a hollow region 17. The hollow region 17 is enclosed by the first end 11 and the second end 12 opposing each other in the vertical direction (Y-axis direction), a left side 13 and a right side 14 opposing each other in the left-right direction (X-axis direction), and a front side 15 and a rear side 16 opposing each other in the front-rear direction (Z-axis direction). In the vicinity of the opening 10, a sound absorbing member 18 is provided.

The pilaster-shaped acoustic resonator 1L has substantially the same outer shape as a pilaster of an upright piano except for the opening. The right side 13 is screwed to the upper front board 20 so that the first end 11 is the lower end and the second end 12 is the upper end, and the left side 14 is in contact with the side board 23L.

Since the front side 15 is a portion exposed to the outside of the case 2, it is preferable that the front side 15 be painted similarly to a typical pilaster.

The sound absorbing member 18 is made of urethane foam, that serves as resistance against the movement of gas particles and inhibits the movement of the gas particles. The sound absorbing member 18 exhibits a high sound absorbing effect by being disposed at a place of high particle speeds. Standing waves generated in the hollow region 17 of the pilaster-shaped acoustic resonator 1L suffer energy dissipation caused by the sound absorbing member 18 provided at the opening 10. As a result, it is possible to adjust the degree of suppression of standing waves in the upright piano.

Here, a material other than urethane foam can be used as long as the material prevents movement of gas particles and generates (increases) resistance to that movement. Urethane foam is an example of an open-cell porous material, but an open-cell porous material using another resin material (for example, a foamed resin) may be used. Further, a material having at least partially a closed cell porous material may be used.

In addition, members applicable to the sound absorbing member 18 are not limited to those with many-holed structures, and include structures which can be regarded as porous to sound waves. Examples include members that form a structure that can be regarded as a porous material due to entanglement of glass fibers, such as glass wool. Included among these members are not only those formed by weaving fabric material but also those formed without weaving fabric material (for example, non-woven fabric, metallic fiber board). In addition, it is also possible to use various materials for the sound absorbing material 18 such as metal (for example, aluminum foam metal, metallic fiber board), wood (for example, wood chips or fragments thereof), paper (wood fiber, pulp fiber), glass (for example, a microperforated panel, micro-hole panel, and one in which fine pores are formed by etching treatment), animal and plant fibers (bovine felt, recovered wool felt, wool, cotton, nonwoven fabric, cloth, synthetic fiber, wood powder molding material, paper molding material).

Figure 4:
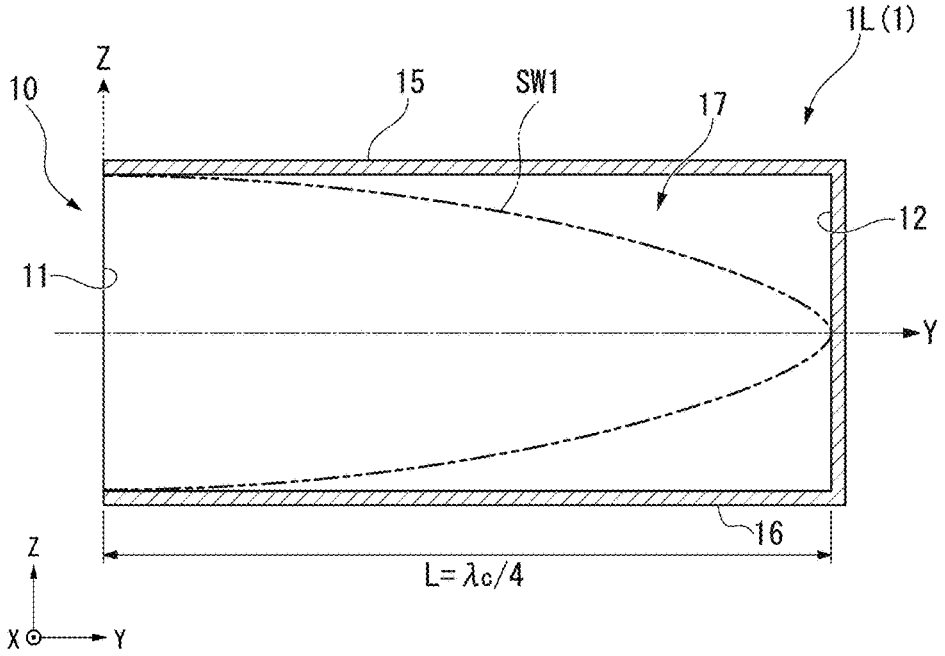
FIG. 4 is a cross-sectional view showing the acoustic resonator shown in FIG. 3.

FIG. 4 is a cross-sectional view of the pilaster-shaped acoustic resonator 1L in the Y-Z plane. Note that in FIG. 4, the pilaster-shaped acoustic resonator 1L is shown so that the Y axis is the horizontal axis and the Z axis is the vertical axis.

In the following description, as shown in FIG. 4, a distance in the Y-axis direction between the first end 11 and the second end 12 is set to L. Further, the Y-Z coordinate of the intersection between the Y axis and the second end 12 is expressed as (Y, Z)=(L, 0), where the intersection point of the Y axis and the first end 11 is the origin of the YZ coordinate.

The double-dotted and dashed line shown in FIG. 4 expresses the particle velocity distribution (amplitude distribution) of gas particles (here, air) in relation to a standing wave SW1 having the lowest frequency, that is, the first-order resonance frequency, among standing waves that can occur in the hollow region 17 of the pilaster-shaped acoustic resonator 1L.

As shown in FIG. 4, a standing wave is generated in the hollow region 17 of the pilaster-shaped acoustic resonator 1L so as to satisfy the boundary condition where the particle velocity at the second end 12 is zero. That is, in the standing wave SW1, there is a "node" of the particle velocity distribution at the position of the second end 12 where the particle velocity becomes a minimum. Also, there is an "antinode" of the particle velocity distribution at the position of the first end 11 where the particle velocity becomes a maximum.

The standing wave SW1 develops by the occurrence of resonance in the pilaster-shaped acoustic resonator 1L in response to sound waves of wavelength λc (L=λc/4) corresponding to four times the length L of the hollow region 17. At this time, the pilaster-shaped acoustic resonator 1L radiates a reflected wave, which is a reflected wave caused by resonance and having a phase different from the phase of the incident wave, to the external space via the first end 11. In accordance with the phase difference between the reflected wave and the incident wave at this time, sound waves of the resonance frequency corresponding to the wavelength κc interfere and cancel each other. Thereby the effect is exhibited of reducing the sound pressure in the vicinity of the first end 11 centered on the resonance frequency of the pilaster-shaped acoustic resonator 1L. As a result, the pilaster-shaped acoustic resonator 1L can suppress standing waves at the resonance frequency in the acoustic space (internal space) of the case 2.

That is, assuming that the resonance frequency of the standing wave to be suppressed in the acoustic space in the case 2 is a resonance frequency that easily resonates in the pilaster-shaped acoustic resonator 1L (hereinafter referred to as "first resonance frequency"), the pilaster-shaped acoustic resonator 1L can suppress the standing wave of the resonance frequency in the acoustic space in the case 2. The pilaster-shaped acoustic resonator 1L is adjusted so as to facilitate resonance at the first resonance frequency.

In the upright piano 100 according to the present embodiment, standing waves having a resonance frequency of about 180 Hz, which cause a "muffled sound," are targeted for suppression, among standing waves that can occur in the acoustic space inside the case. That is, the pilaster-shaped acoustic resonator 1L is adjusted so as to suppress the generation of standing waves with a resonance frequency of about 180 Hz (the first resonance frequency) in the acoustic space inside the case of the upright piano 100. In the present embodiment, the pilaster-shaped acoustic resonator 1L is adjusted so that the primary resonance frequency of the pilaster-shaped acoustic resonator 1L is about 180 Hz (the first resonance frequency).

The adjustment of the resonance frequency of the pilaster-shaped acoustic resonator 1L is mainly performed by the length L of the hollow region 17, but fine adjustment can be performed by the sound absorbing member 18. For example, by increasing the area exposed to the opening 10 of the sound absorbing member 18 disposed in the vicinity of the opening 10, the resonance frequency can be lowered by utilizing the transition property from tube resonance to Helmholtz resonance.

As shown in FIG. 2, the opening 10 of each of the pair of pilaster-shaped acoustic resonators 1L and 1R is arranged at the lower end of the upper front board 20 and at the left and right ends of the upper front board 20. According to an experiment conducted by the inventors, in an upright piano, this location is positioned in proximity to the position of an "antinode" of sound pressure of low-order standing waves of the fifth order or less, and in proximity to the position of a "node" of sound pressure of high-order standing waves from the sixth order to the 10th order, among standing waves generated in the acoustic space of the case 2.

The pair of pilaster-shaped acoustic resonators 1L and 1R of the present embodiment are designed to suppress the occurrence of the "muffled sound" in the vicinity of 180 Hz. Each opening 10 is arranged in proximity to the position of the "antinode" of sound pressure of low-order standing waves (that is, closer to the position of the antinode of the sound pressure compared to the position of the node of the sound pressure). Thereby, compared to the case of being disposed at a location where the "antinode" of the sound pressure is not positioned, it is possible to favorably suppress standing waves of the first resonance frequency in the acoustic space inside the case 2.

Conversely, each of the openings 10 is disposed in proximity to the "node", rather than the position of the "antinode", of sound pressure of high-order standing waves (that is, closer to the position of the node of the sound pressure compared to the position of the antinode of the sound pressure). Therefore, suppression of high-order standing waves in the acoustic space inside the case 2 hardly occurs.

By disposing the opening 10 of each of the pair of pilaster-shaped acoustic resonators 1L and 1R at the aforementioned position, it is possible to favorably suppress low-order standing waves that are the target of suppression, and it is possible to reduce unintended effects on high-order standing waves which are not the target of suppression.

Further, as shown in FIG. 1, the pair of pilaster-shaped acoustic resonators 1L and 1R are disposed at the left and right ends of the upper front board 20. These positions are end portions in the acoustic space inside the case 2 and are positions where each pilaster was originally disposed. Therefore, disposing the pair of pilaster-shaped acoustic resonators 1L and 1R at these positions does not easily cause disturbance of the sound field in the acoustic space inside the case 2, and also has minimal unintended effect on the frequency characteristic.

Advantageous Effect of the First Embodiment

According to the upright piano 100 provided with the acoustic resonator 1 of this embodiment configured as described above, standing waves of the first resonance frequency generated in the case 2 can be suppressed. By arranging the opening 10 in proximity to the "antinode" of sound pressure of low-order standing waves, it is possible to suppress the occurrence of low-order standing waves, which are the cause of "sound muffling".

Further, according to the upright piano 100 including the acoustic resonator 1 of the present embodiment, the opening 10 is arranged in proximity to the "node" of sound pressure of high-order standing waves. Therefore, suppression of high-order standing waves in the acoustic space inside the case 2 hardly occurs.

Further, according to the upright piano 100 including the acoustic resonator of the present embodiment, the pilaster-shaped acoustic resonator 1 has almost the same external appearance as a pilaster and is arranged replacing each pilaster. Therefore, disturbance of the sound field in the acoustic space is hardly caused, and unintended effects on the frequency characteristic are minimal. Furthermore, the external appearance of the acoustic piano is not impaired.

An experiment was carried out to measure the internal sound pressure of the upright piano 100 provided with the pair of pilaster-shaped acoustic resonators 1L and 1R (that is, having resonance tubes) and the internal sound pressure of an upright piano provided with existing pilasters 2aL and 2aR instead of the pilaster-shaped acoustic resonators 1L and 1R (that is, not having resonance tubes). In the experiment, a speaker was arranged in the case of each upright piano and made to reproduce white noise, with the sound pressure at one point in the case of the upright piano being measured. The pair of pilaster-shaped acoustic resonators 1L and 1R were adjusted so that the first-order resonance frequency was around 180 Hz (the first resonance frequency) similarly to the first embodiment.

Figure 5:
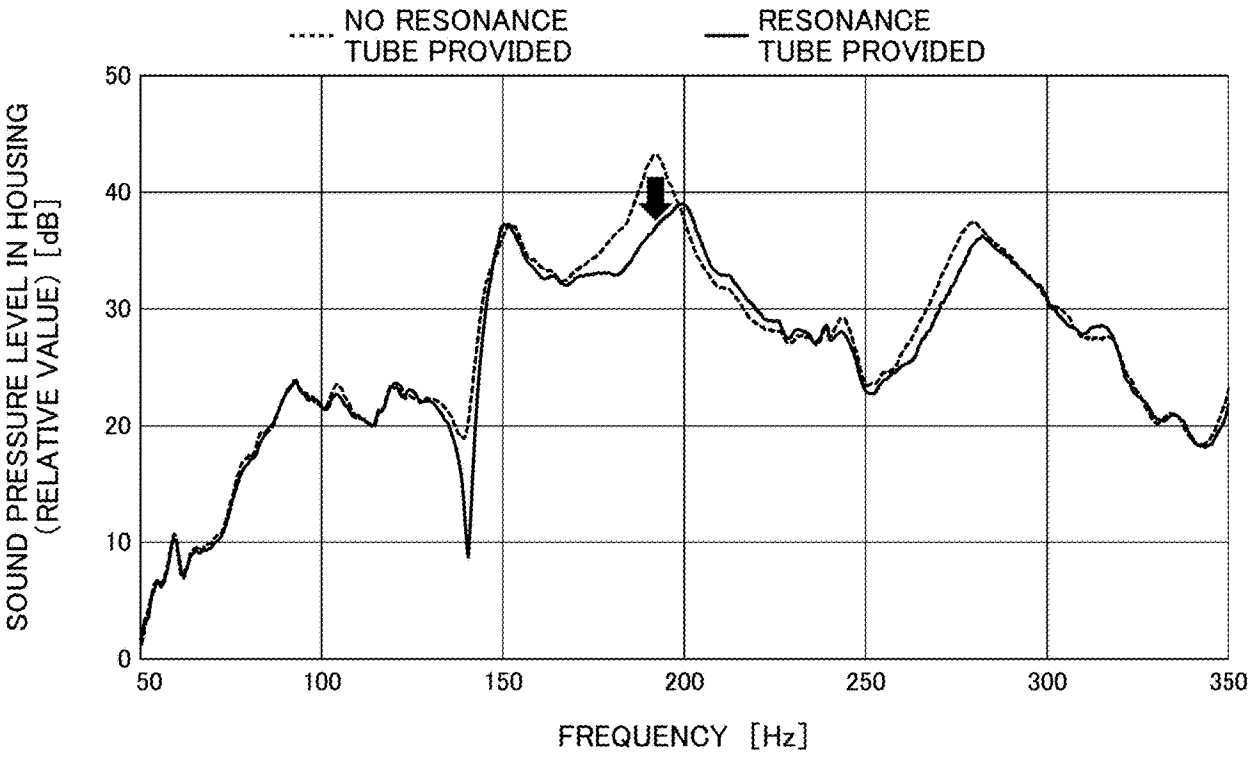
FIG. 5 is a graph showing measurement results of internal sound pressure of the upright piano shown in FIG. 1.

FIG. 5 shows the measurement results of the experiment. As shown in FIG. 5, compared with the frequency characteristic of the upright piano not provided with the pair of pilaster-shaped acoustic resonators 1L and 1R, in the frequency characteristic of the upright piano 100 having the pair of pilaster-shaped acoustic resonators 1L and 1R, the sound pressure level decreased around 180 Hz (with this sound pressure decrease leading to a reduction of the aforementioned "muffled sound"). It was therefore confirmed that the sound pressure level at around the suppression target of 180 Hz (the first-resonance frequency) could be suppressed by replacing the pilasters with the pair of pilaster-shaped acoustic resonators 1L and 1R.

While the first embodiment of the present invention has been described and illustrated in detail heretofore with reference to the drawings, it should be understood that specific constitutions are not limited to the present embodiments. Additions, omissions, substitutions, and other modifications can be made without departing from the spirit or scope of the present invention. Accordingly, the invention is not to be considered as being limited by the foregoing description, and is only limited by the scope of the appended claims. In addition, the constituent elements shown in the first embodiment and the modification examples described below can be combined appropriately.

(Modification 1)

For example, in the above-described embodiment, the pilaster-shaped acoustic resonators 1L and 1R replaced the pilasters, but the members to be replaced are not limited to the pilasters. For example, the acoustic resonator may be formed in the shape of the side board or the key bed to replace all or part of the side board or key bed. When the acoustic resonator is arranged in a manner replacing an existing member, disturbance of the sound field in the acoustic space is hardly caused, and unintended effects on the frequency characteristic are minimal. Furthermore, the external appearance of the acoustic piano is not impaired.

(Modification 2)

For example, in the above-described embodiment, the pilaster-shaped acoustic resonators 1L and 1R replaced both the right and left pilasters, but the mode of arrangement of the acoustic resonators is not limited thereto. As an acoustic resonator, only either one of the pair of pilaster-shaped acoustic resonators 1L and 1R may be disposed in a manner replacing a pilaster. Even if only one of the pilasters is replaced, it is still possible to suppress the generation of standing waves of the first resonance frequency, and moreover it is possible to reduce the installation cost.

(Modification 3)

For example, although the aforesaid pilaster-shaped acoustic resonators 1L and 1R are resonance tubes in the above embodiment, the mode of the acoustic resonator is not limited thereto. The acoustic resonator may be, for example, a Helmholtz resonator. Also, the acoustic resonator may be a resonance tube with openings at both ends. Any type of acoustic resonator may be used as long as the resonator is one that can be arranged in a manner replacing a part of the case.

Second Embodiment

A second embodiment of the present invention will be described with reference to FIGS. 6 to 10. In the second embodiment, the acoustic resonator (resonance tube) is arranged in the acoustic space (internal space) in the case as the same as in the first embodiment. On the other hand, the second embodiment differs from the first embodiment in that the acoustic resonator (resonance tube) is not replacing a part of the case. In the following description, the same reference numerals are given to the same components as in the first embodiment already described with redundant descriptions thereof being omitted.

Figure 6:
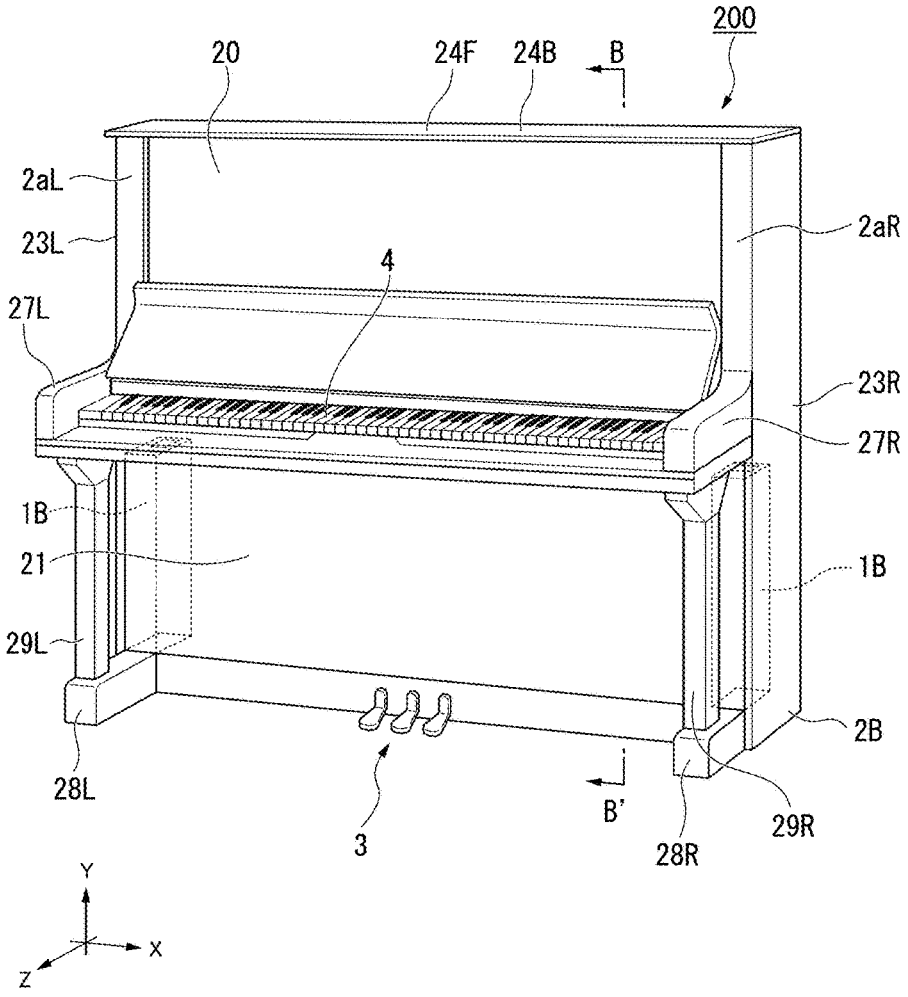
FIG. 6 is a perspective view showing an upright piano according to a second embodiment of the present invention.
Figure 7:
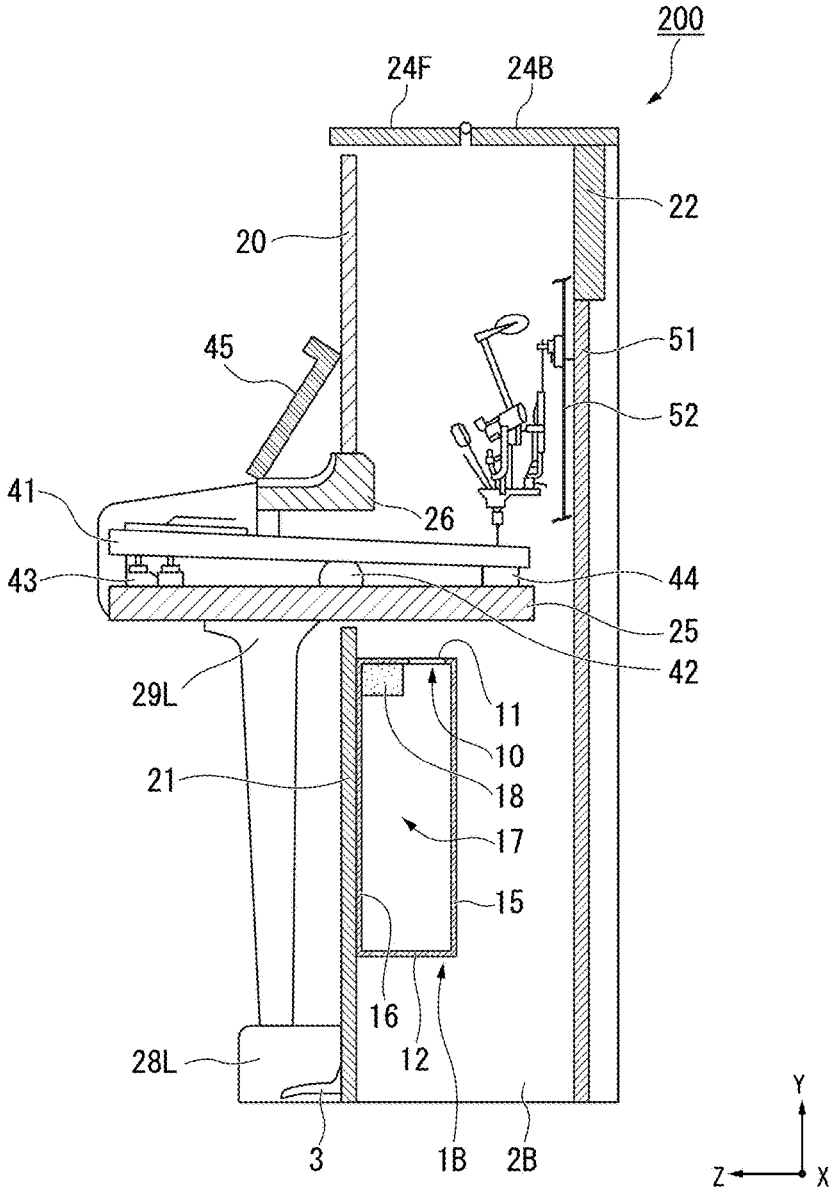
FIG. 7 is a cross-sectional view taken along line B-B' of the upright piano shown in FIG. 6.

FIG. 6 is a perspective view showing the overall configuration of an upright piano 200. FIG. 7 is a cross-sectional view taken along line BB' of the upright piano 200 shown in FIG. 6.

As shown in FIGS. 6 and 7, the upright piano 200 is provided with a case 2B including an acoustic resonator (resonance tube) 1B, a pedal unit 3, a keyboard 4, and a sound generating unit 5.

As shown in FIGS. 6 and 7, the case 2B has a left and right pair of pilasters 2aL and 2aR in addition to an acoustic resonator 1B, an upper front board 20, a lower front board 21, a pin board 22, a left and right pair of side boards 23L and 23R, a rear top board 24B, a front top board 24F, a key bed 25, a front rail 26, a left and right pair of side arms 27L and 27R, a left and right pair of toe blocks 28L and 28R, and a left and right pair of legs 29L and 29R.

The case 2B excluding the acoustic resonator 1B has the same configuration as a typical upright piano. That is, in the upright piano 200, the case 2B is one in which the acoustic resonator 1B is added to a case of a typical upright piano.

The acoustic resonator 1B has the same configuration as the abovementioned pilaster-shaped acoustic resonator 1L of the first embodiment. As shown in FIGS. 6 and 7, two of the acoustic resonators 1B are disposed on the left and right end sides of the lower front board 21. The acoustic resonator 1B is attached with a rear side 16 in contact with the lower front board 21 so that a first end 11 is upward and a second end 12 is downward. As shown in FIGS. 6 and 7, an opening 10 is disposed at a position close to the opening in each of the acoustic resonators 1R and 1L in the first embodiment. That is, the opening 10 is provided at the upper end of the lower front board 21.

Figure 8A:
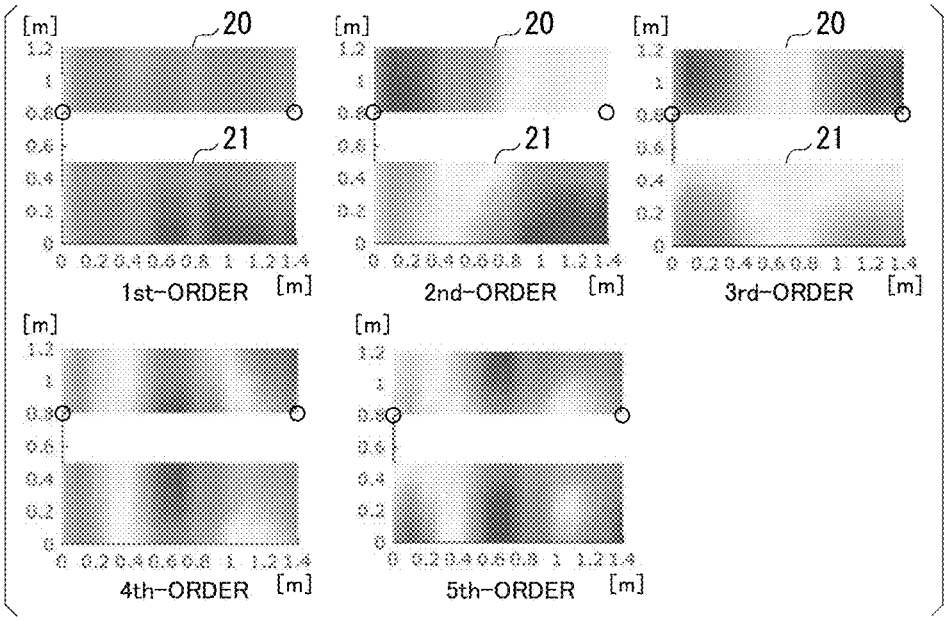
FIGS. 8A and 8B are graphs showing measurement results of sound pressure distribution in a conventional upright piano.
Figure 8B:
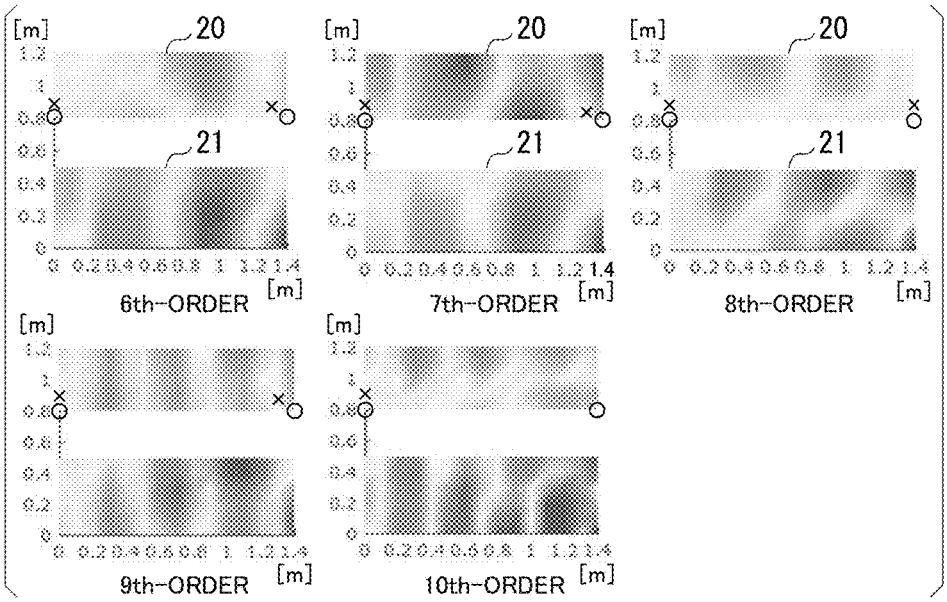

FIGS. 8A and 8B show the results of calculating, by simulation, the sound pressure distribution of standing waves (first to 10th order) generated in the case in a typical upright piano not having the acoustic resonator 1B. More specifically, the sound pressure distribution was calculated by simulation at the upper front board 20 and the lower front board 21 constituting the case of the piano. FIG. 8A shows the first-order to fifth-order standing waves generated at the upper front board 20 and the lower front board 21, while FIG. 8B shows the sixth-order to 10th-order standing waves generated at the upper front board 20 and the lower front board 21.

In each of the graphs shown in FIGS. 8A and 8B, the upper rectangular portion indicates a standing wave generated in the upper front board 20, and the lower rectangular portion indicates a standing wave generated at the lower front board 21. Therefore, the vertical axis and the horizontal axis of these graphs respectively correspond to the Y axis and the X axis. The numbers on the vertical axis and the horizontal axis of these graphs indicate length (m) viewed from the front of the piano, with the origin at the lower left. In each rectangular part, the dense part of the grayscale image represents the antinode of a standing wave, while the faint part represents the node of a standing wave.

As shown in FIG. 8A, of the standing waves generated in the acoustic space (internal space) in the case 2, the "antinodes" of sound pressure of low-order standing waves of the fifth-order or less are positioned in proximity to the place where the opening 10 is located (the portion indicated by the ○ symbol in FIG. 8A). For that reason, by arranging the opening 10 at the place where many of the antinodes of low-order standing waves appear, it is possible to favorably suppress the occurrence of standing waves that are the suppression target.

Conversely, as shown in FIG. 8B, the "nodes" of sound pressure of higher-order standing waves of about the sixth-order to about the 10th-order, which are not to be suppressed (the portion indicated by the x symbol), are positioned in proximity to the place where the opening 10 is located. Here, the "node" of sound pressure of standing waves is a portion where the sound pressure amplitude is a minimum value. Therefore, in high-order standing waves, even if the opening 10 is arranged in the vicinity of the place where many of these nodes appear, suppression of high-order standing waves hardly occurs.

Advantageous Effect of the Second Embodiment

According to the upright piano 200 provided with the acoustic resonator of this embodiment configured as described above, it is possible to suppress standing waves of the first resonance frequency generated in the case 2B. The acoustic resonator 1B is arranged at the left and right end side of the acoustic space inside the case 2B. Therefore, even if a pair of the acoustic resonators 1B are disposed at these locations, disturbance of the sound field in the acoustic space is hardly caused, and unintended influence on the frequency characteristic is small.

In addition, according to the upright piano 200 including the acoustic resonator of the present embodiment, by arranging the opening 10 in the vicinity of the "antinodes" of sound pressure of low-order standing waves as in the first embodiment, it is possible to suppress the occurrence of low-order standing waves, which are a cause of "sound muffling". Further, the opening 10 is disposed near the "nodes" of sound pressure of high-order standing waves. Therefore, suppression of high-order standing waves in the acoustic space inside the case 2B hardly occurs.

Further, according to the upright piano 200 provided with the acoustic resonator of the present embodiment, compared with the case in which the acoustic resonator 1 is disposed in a manner replacing an existing member of the upright piano as in the first embodiment, it is possible to easily arrange the resonator 1 in the case 2B.

While the second embodiment of the present invention has been described and illustrated in detail heretofore with reference to the drawings, it should be understood that specific constitutions are not limited to the present embodiments. Additions, omissions, substitutions, and other modifications can be made without departing from the spirit or scope of the present invention. Accordingly, the invention is not to be considered as being limited by the foregoing description, and is only limited by the scope of the appended claims. In addition, the constituent elements shown in the second embodiment and the modification examples described below can be combined appropriately.

(Modification)

Figure 9:
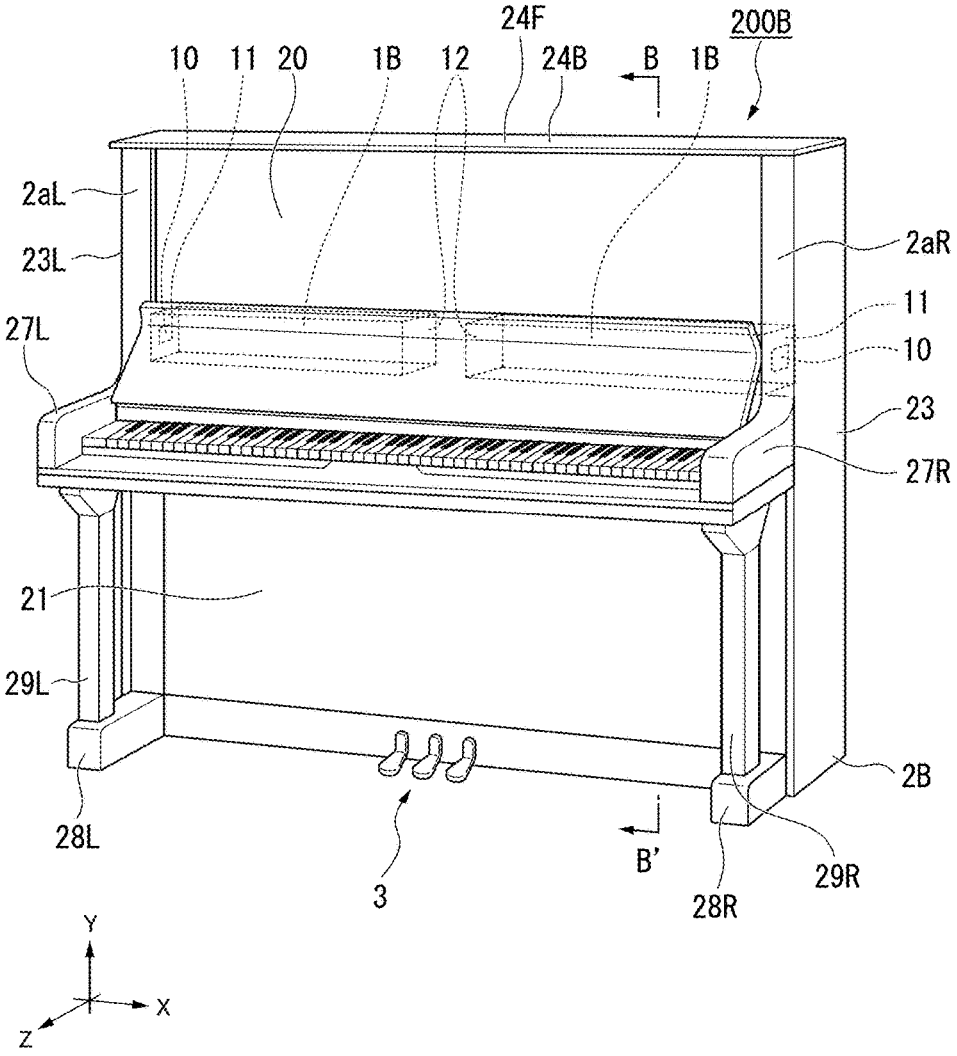
FIG. 9 is a perspective view showing an upright piano according to a modification of the second embodiment.
Figure 10:
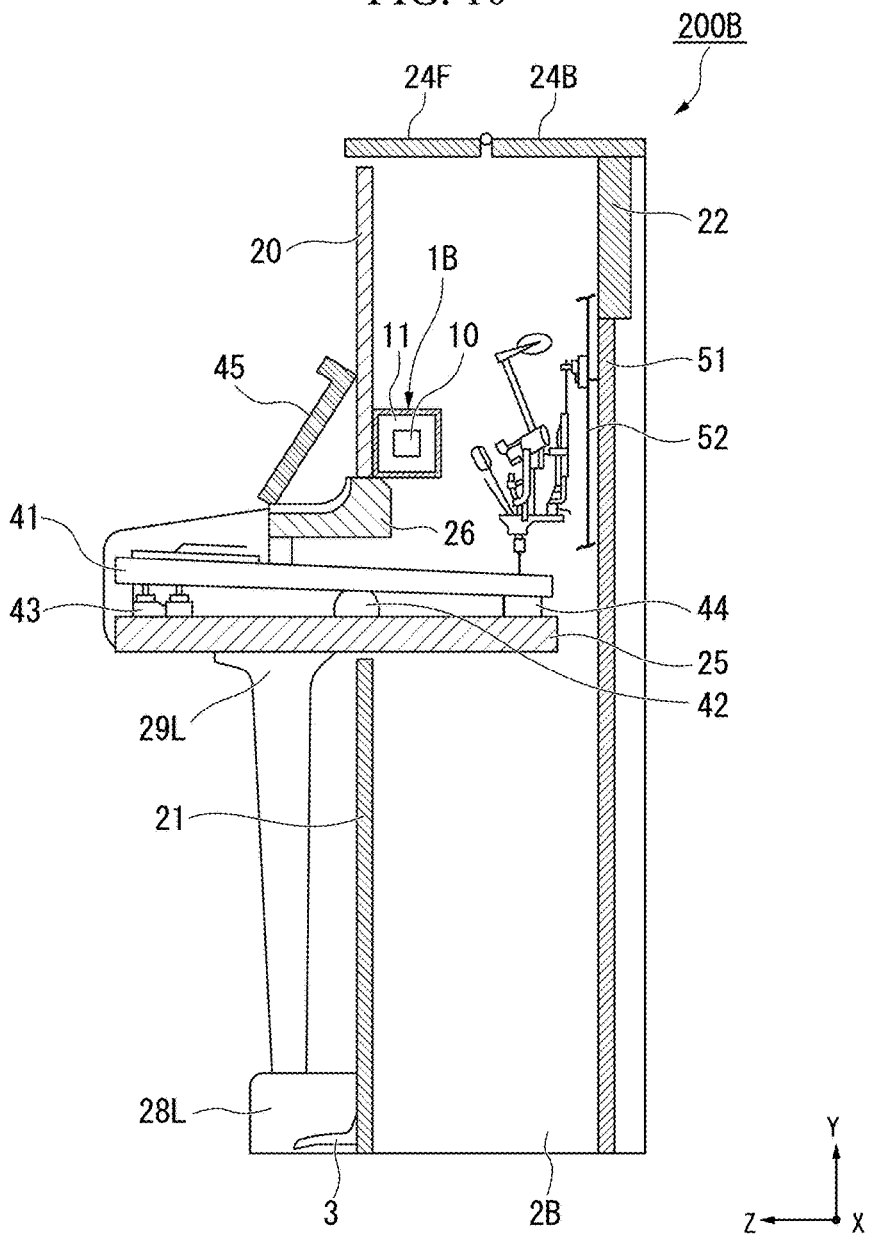
FIG. 10 is a cross-sectional view taken along line B-B' of the upright piano shown in FIG. 6.

In the second embodiment, the acoustic resonator 1B is attached to the lower front board 21, but the place of attaching the acoustic resonator 1B is not limited thereto provided the place of attachment is the acoustic space (internal space) of the case. FIG. 9 is a perspective view showing the entire configuration of an upright piano 200B according to a modification of the upright piano 200. FIG. 10 is a cross-sectional view of the upright piano 200B shown in FIG. 9 taken along line B-B'.

As shown in FIGS. 9 and 10, the two acoustic resonators (resonance tubes) 1B are attached near the lower end on the upper front board 20 such that the second end 12 of each face each other in the X-axis direction. The two acoustic resonators 1B are attached to the upper front board 20 such that the first ends 11 are on the left and right end side and the second ends 12 are on the center side. As shown in FIGS. 9 and 10, the opening 10 is disposed at a position close to the opening 10 of the first embodiment. That is, the opening 10 of the acoustic resonator 1B is disposed at the lower end of the upper front board 20.

Also in the upright piano 200B, similarly to the first embodiment, by disposing the opening 10 in the vicinity of the "antinodes" of sound pressure of low-order standing waves, it is possible to suppress the occurrence of low-order standing waves, which are a cause of "sound muffling". Further, the opening 10 is arranged near the "nodes" of sound pressure of high-order standing waves. Therefore, suppression of high-order standing waves in the acoustic space inside the case 2B hardly occurs.

The acoustic resonator 1B can exhibit the same effect as the aforedescribed embodiments by arranging the opening 10 in the vicinity of the "antinodes" of sound pressure of low-order standing waves and in the vicinity of "nodes" of sound pressure of high-order standing waves in the sound pressure distribution shown in FIG. 8.

As described above, according to the present invention, it is possible to provide an upright piano that, by having an acoustic resonator disposed in a case thereof, is capable of suppressing standing waves of a specific resonance frequency generated in the case by an acoustic resonator being disposed in the case, with unintended effects on the frequency characteristic being minimal and the external appearance not being impaired.

What is claimed is:

1. An upright piano comprising:

a case including an upper front board, a key bed disposed below the upper front board, and a lower front board disposed below the key bed, defining an internal space; and a resonance tube, provided with a hollow region and an opening, disposed in the internal space, wherein the opening is disposed at a left or right end side of either a lower end side of the upper front board or an upper end side of the lower front board.

2. The upright piano according to claim 1, wherein part of the resonance tube is composed of part of the case.

3. The upright piano according to claim 2, wherein:

the case includes a pilaster disposed at each of the left and right end side of the upper front board, and part of the resonance tube is composed of one of the pilasters.

4. The upright piano according to claim 1, wherein the opening is disposed at a position of antinodes of sound pressure in first- to fifth-order standing waves, among standing waves generated in the internal space.

5. The upright piano according to claim 2, wherein the opening is disposed at a position of antinodes of sound pressure in first- to fifth-order standing waves, among standing waves generated in the internal space.

6. The upright piano according to claim 3, wherein the opening is disposed at a position of antinodes of sound pressure in first- to fifth-order standing waves, among standing waves generated in the internal space.

7. The upright piano according to claim 1, wherein the opening is disposed at a position of nodes of sound pressure in sixth- to 10th-order standing waves, among standing waves generated in the internal space.

8. The upright piano according to claim 2, wherein the opening is disposed at a position of nodes of sound pressure in sixth- to 10th-order standing waves, among standing waves generated in the internal space.

9. The upright piano according to claim 3, wherein the opening is disposed at a position of nodes of sound pressure in sixth- to 10th-order standing waves, among standing waves generated in the internal space.

* * * * *